US012729024B2

(12) United States Patent
Italiano et al.

(10) Patent No.: US 12,729,024 B2
(45) Date of Patent: Sep. 8, 2026

(54) APPARATUS, MACHINE AND METHOD FOR WRAPPING A LOAD

(71) Applicant: ROBOPAC S.P.A., Acquaviva-Gualdicciolo (SM)

(72) Inventors: Giuseppina Italiano, Acquaviva-Gualdicciolo (SM); Simone Pari, Acquaviva-Gualdicciolo (SM); Marco Bernardi, Acquaviva-Gualdicciolo (SM); Michael Mancini, Acquaviva-Gualdicciolo (SM)

(73) Assignee: ROBOPAC S.P.A., Acquaviva-Gualdicciolo (SM)

( * ) Notice: Subject to any disclaimer, the term of this patent is extended or adjusted under 35 U.S.C. 154(b) by 114 days.

(21) Appl. No.: 18/860,793

(22) PCT Filed: Apr. 26, 2023

(86) PCT No.: PCT/IB2023/054306
§ 371 (c)(1),
(2) Date: Oct. 28, 2024

(87) PCT Pub. No.: WO2023/209597
PCT Pub. Date: Nov. 2, 2023

(65) Prior Publication Data

US 2026/0176012 A1 Jun. 25, 2026

(30) Foreign Application Priority Data

Apr. 29, 2022 (IT) ..... 102022000008711

(51) Int. Cl.
*B65B 11/00* (2006.01)
*B65B 11/04* (2006.01)
(Continued)

(52) U.S. Cl.
CPC ..... *B65B 11/045* (2013.01); *B65B 41/16* (2013.01); *B65B 51/026* (2013.01); *B65B 61/06* (2013.01)

(58) Field of Classification Search
CPC ..... B65B 11/02; B65B 41/12; B65B 11/008; B65B 11/00; B65B 11/045
See application file for complete search history.

(56) References Cited

U.S. PATENT DOCUMENTS 2,716,315 A * 8/1955 Jacoby ..... B65B 11/04 493/299
3,928,939 A * 12/1975 Edwards ..... B65B 11/04 53/442

(Continued)

FOREIGN PATENT DOCUMENTS

EP 3 835 220 6/2021
WO WO 2012/153285 * 11/2012 ..... B65B 11/02
WO 2015/082945 6/2015

OTHER PUBLICATIONS

International Search Report (ISR) issued Aug. 30, 2023 in International (PCT) Application No. PCT/IB2023/054306.

(Continued)

*Primary Examiner* — Gloria R Weeks
(74) *Attorney, Agent, or Firm* — Wenderoth, Lind & Ponack, L.L.P.

(57) ABSTRACT

A wrapping machine for wrapping a load with a paper band includes a table supporting the load and rotatable about a wrapping axis, an unwinding apparatus having a supporting frame for rotatably supporting the reel of paper band and rollers for unwinding and guiding the paper band, and a moving assembly including a moving carriage movable parallel to the wrapping axis and supporting the unwinding apparatus rotatably about an inclination axis. The unwinding apparatus includes a first linking element fixed to the sup- (Continued)

porting frame and a second linking element fixed to the moving carriage. The first and second linking elements are connected to each other in a rotatable way about the inclination axis through a linking pin. A ball supporting element is interposed between the linking elements to slidably support with the linking pin a weight of the unwinding apparatus and facilitating a rotation thereof about the inclination axis.

22 Claims, 6 Drawing Sheets

(51) Int. Cl.

| | |
|---|---|
| ***B65B 41/16*** | (2006.01) |
| ***B65B 51/02*** | (2006.01) |
| ***B65B 61/06*** | (2006.01) |

(56) References Cited

U.S. PATENT DOCUMENTS 4,173,108 A * 11/1979 Eglinton ..... B65B 11/04 53/587
4,497,159 A 2/1985 Lancaster, III
4,725,326 A * 2/1988 Colbachini ..... B65H 81/08 156/425
4,819,408 A * 4/1989 Bertolotti ..... B65B 49/12 53/372.9
4,914,891 A * 4/1990 Suolahti ..... B65H 19/123 53/399
5,040,359 A * 8/1991 Thimon ..... B65H 23/32 53/556
5,195,301 A * 3/1993 Martin-Cocher ..... B65B 11/045 53/465
5,216,871 A * 6/1993 Hannen ..... B65D 71/0096 53/399
5,223,066 A * 6/1993 Dokmo ..... B29C 63/105 156/934
5,447,008 A * 9/1995 Martin-Cocher ..... B65B 11/025 53/399
5,463,842 A * 11/1995 Lancaster ..... B65H 20/34 53/399
5,875,617 A * 3/1999 Scherer ..... B65B 11/025 52/837
5,941,049 A * 8/1999 Lancaster, III ..... B65B 11/045 53/399
6,170,233 B1 * 1/2001 Marois ..... B65B 11/025 53/399
6,584,752 B1 * 7/2003 Herava ..... B65B 11/585 53/399
6,684,612 B2 * 2/2004 Trottet ..... B65B 11/045 53/556
6,688,076 B1 * 2/2004 Rivera, Jr. ..... B65B 25/24 53/204
7,178,317 B1 * 2/2007 Koskela ..... B65B 11/045 53/587
7,533,515 B1 * 5/2009 Koskela ..... B65B 11/025 53/556
8,037,660 B2 * 10/2011 Lancaster, III ..... B65B 11/006 53/399
8,424,271 B2 * 4/2013 Murarotto ..... B65B 11/045 53/399
10,183,773 B2 * 1/2019 Zierden ..... B65B 11/025
10,392,143 B2 * 8/2019 Butturini ..... B65B 45/00
11,667,416 B2 * 6/2023 Lancaster, III ..... B65B 57/12 53/461
2003/0093973 A1 * 5/2003 Mir ..... B65B 11/025 53/399
2010/0064906 A1 3/2010 Rossi
2013/0300047 A1 11/2013 Hendren et al.
2014/0250831 A1 * 9/2014 Suolahti ..... B65B 11/025 29/401.1
2020/0239168 A1 * 7/2020 Sforacchi ..... B65B 61/22

OTHER PUBLICATIONS

Office Action issued Jul. 16, 2026 in corresponding Chinese Application No. 202380036951.1, with English translation.

* cited by examiner

Fig. 1
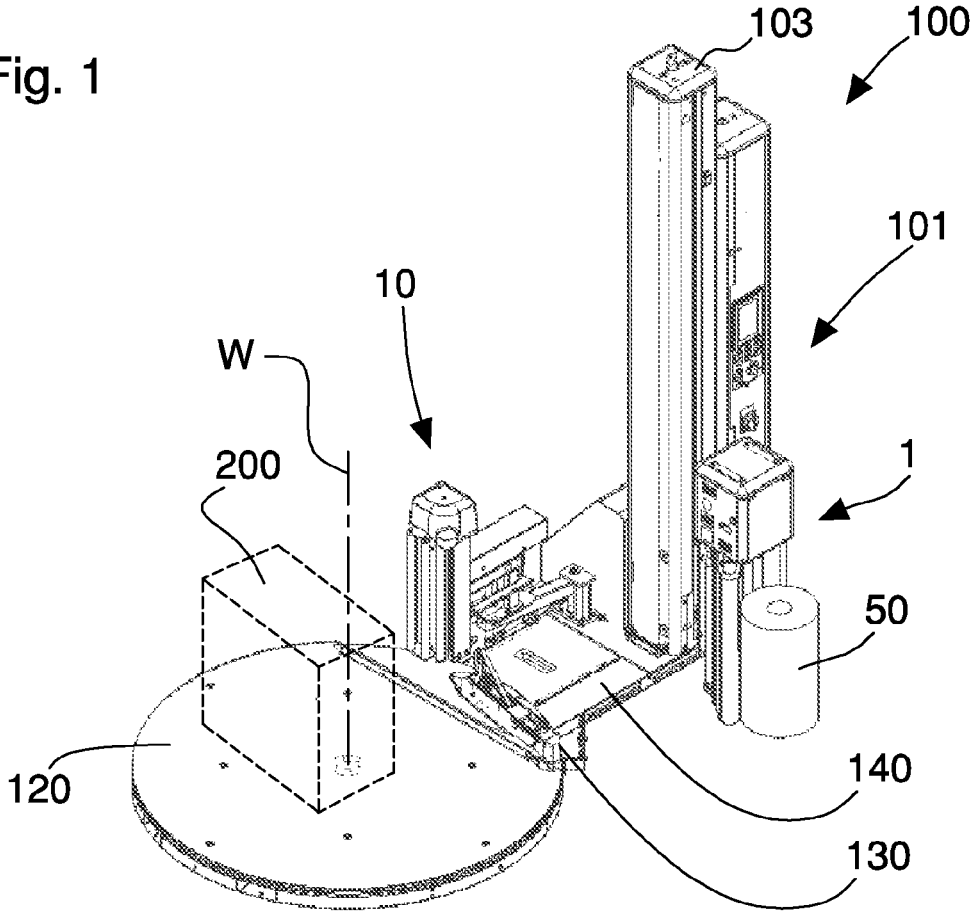
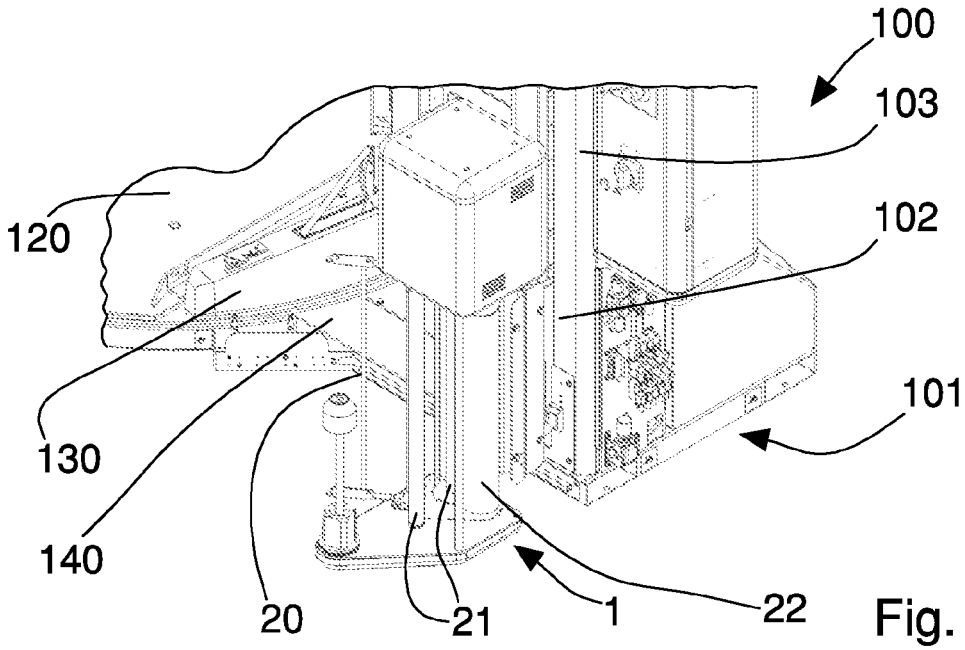
Fig. 2

Fig. 3
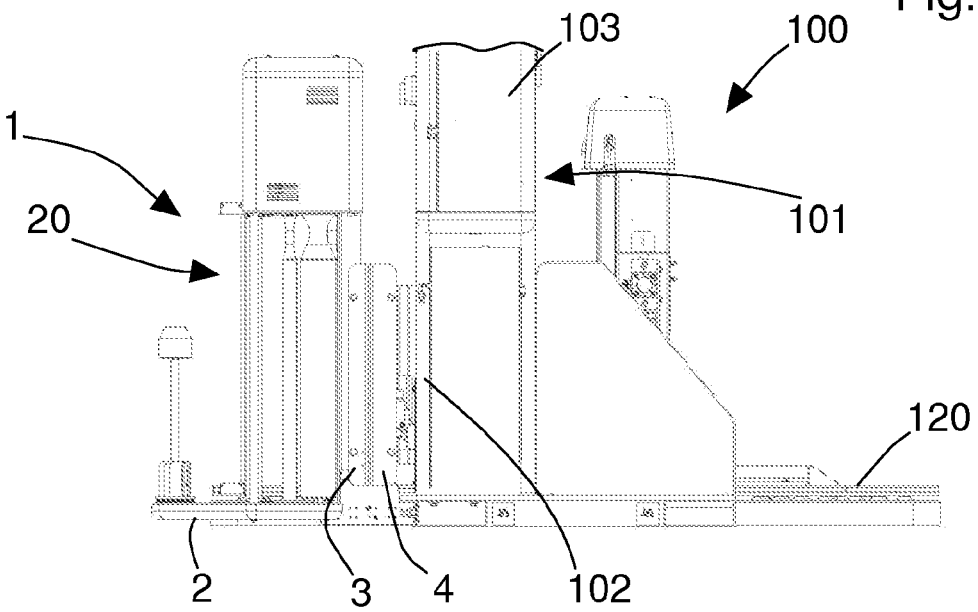
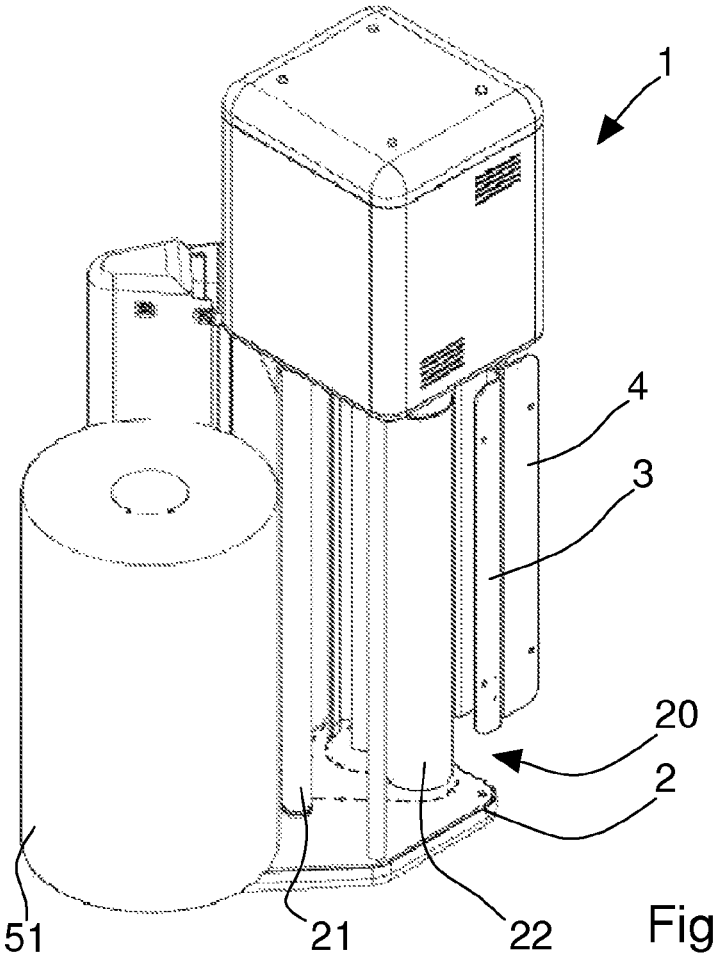
Fig. 4

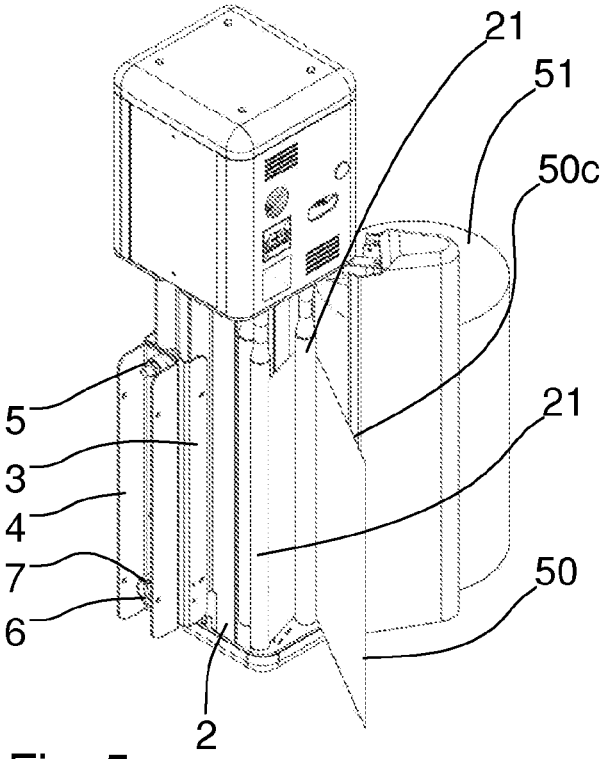
Fig. 5
Fig. 7
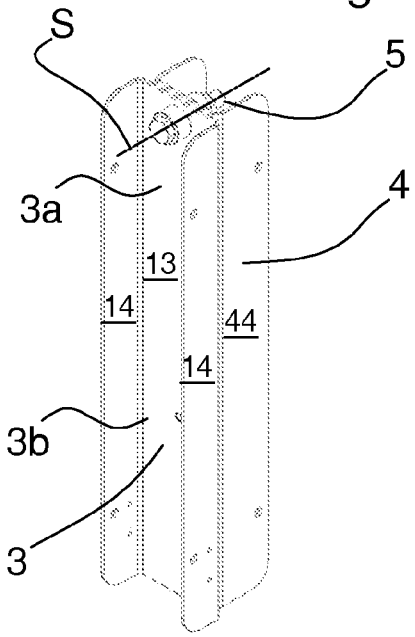
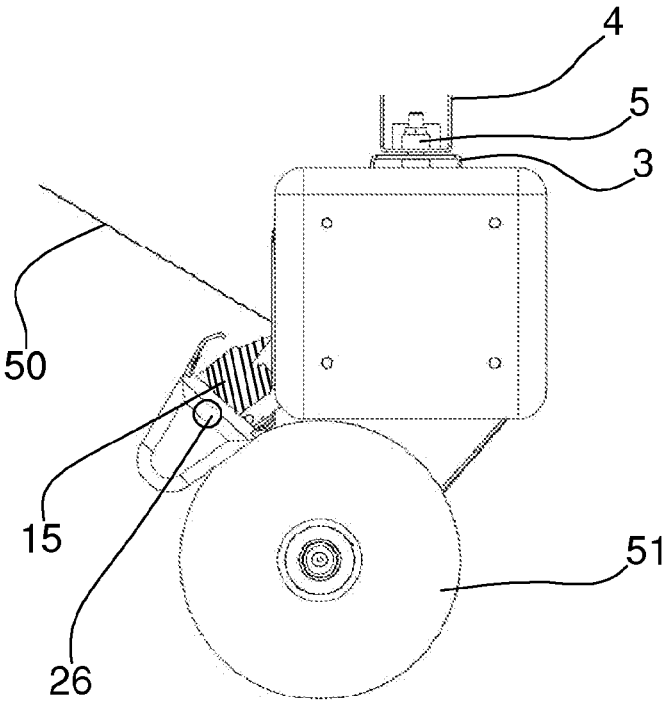
Fig. 6
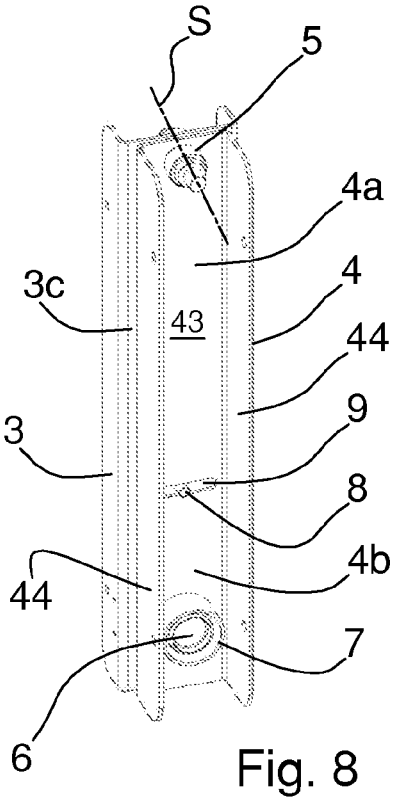
Fig. 8

Fig. 9
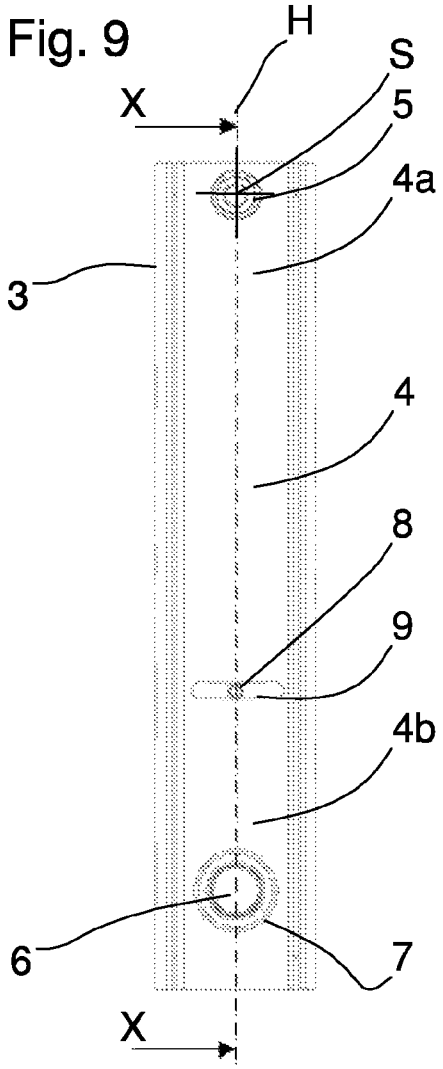
Fig. 10
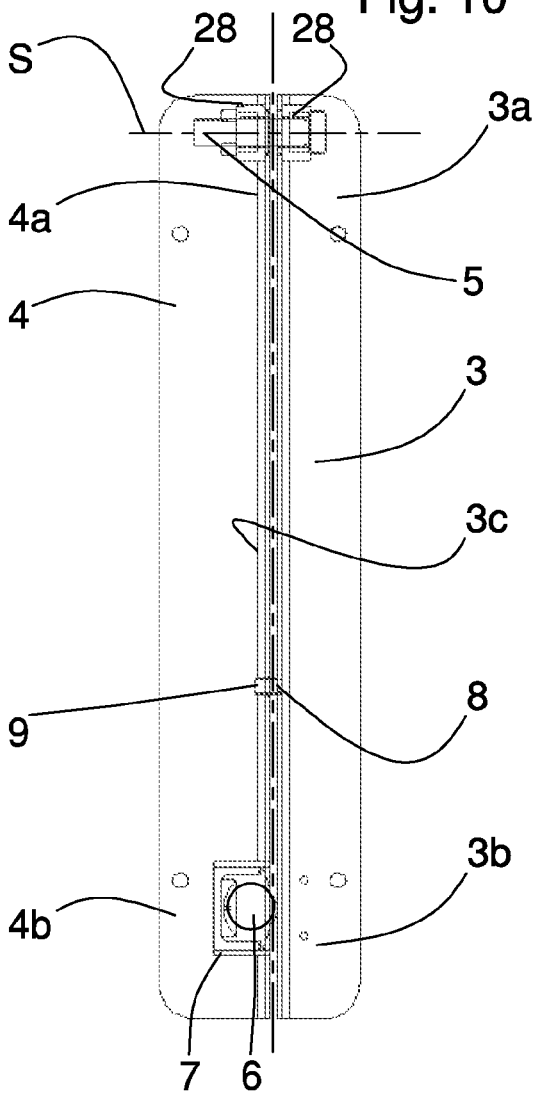
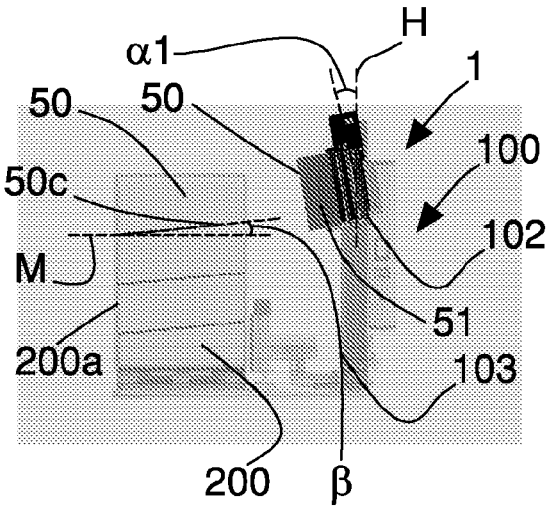
Fig. 11
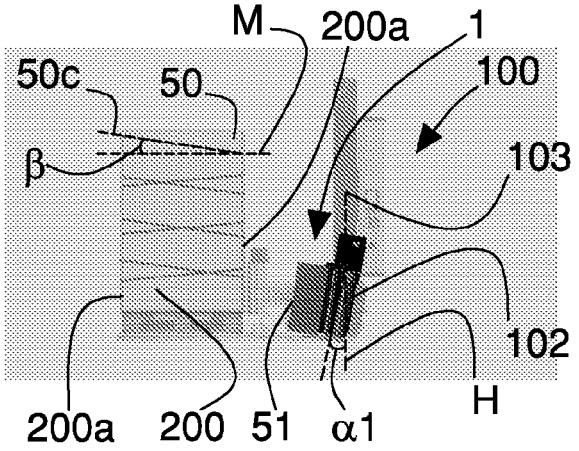
Fig. 12

Fig. 13
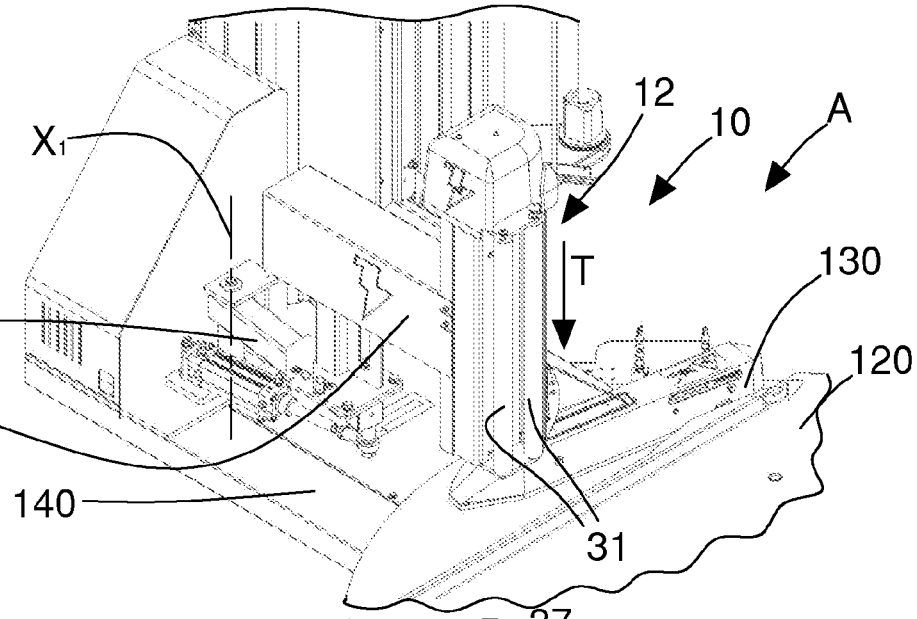
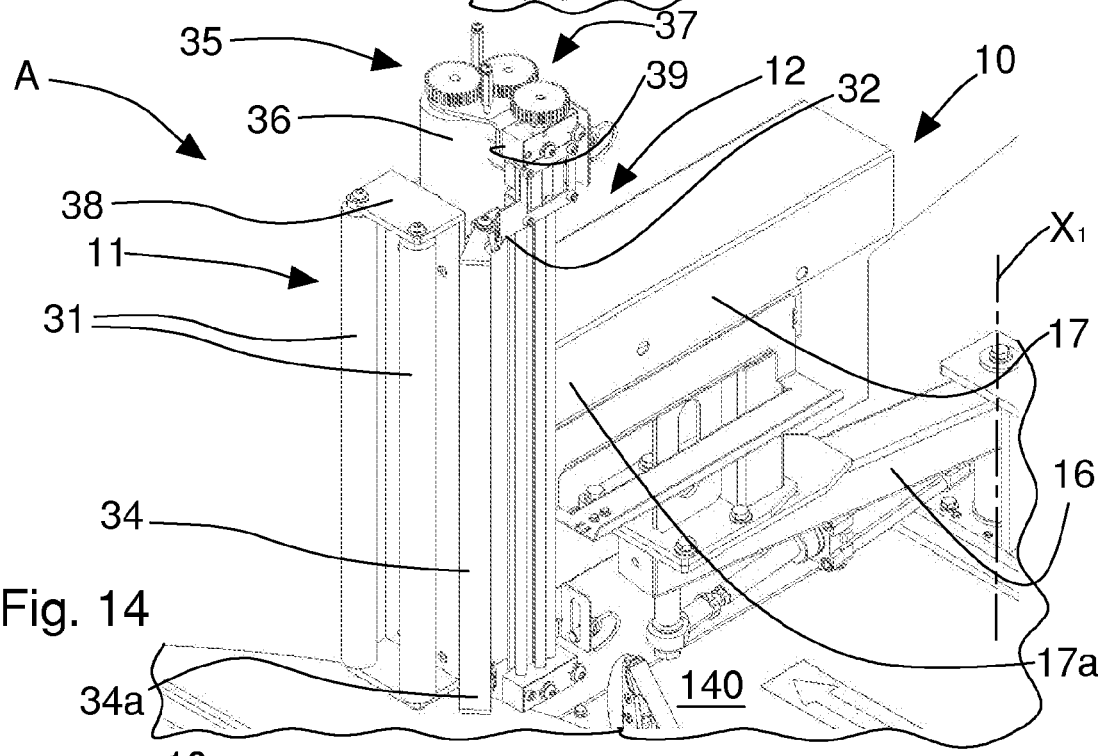
Fig. 14
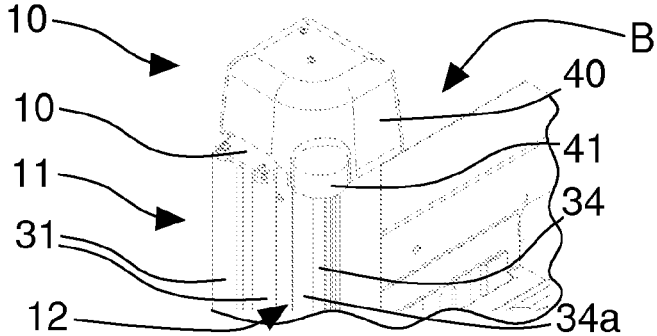
Fig. 15

Fig. 16
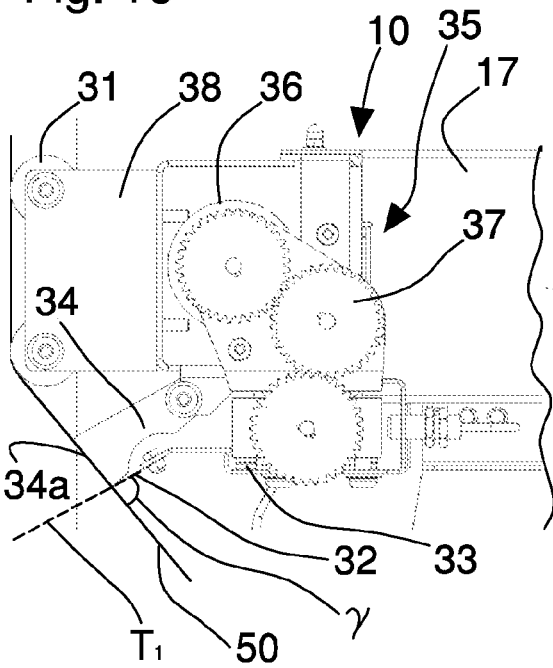
Fig. 17
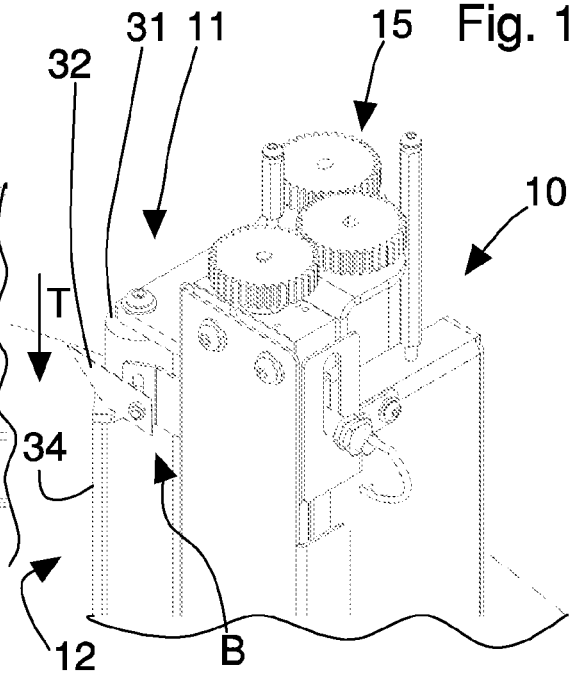
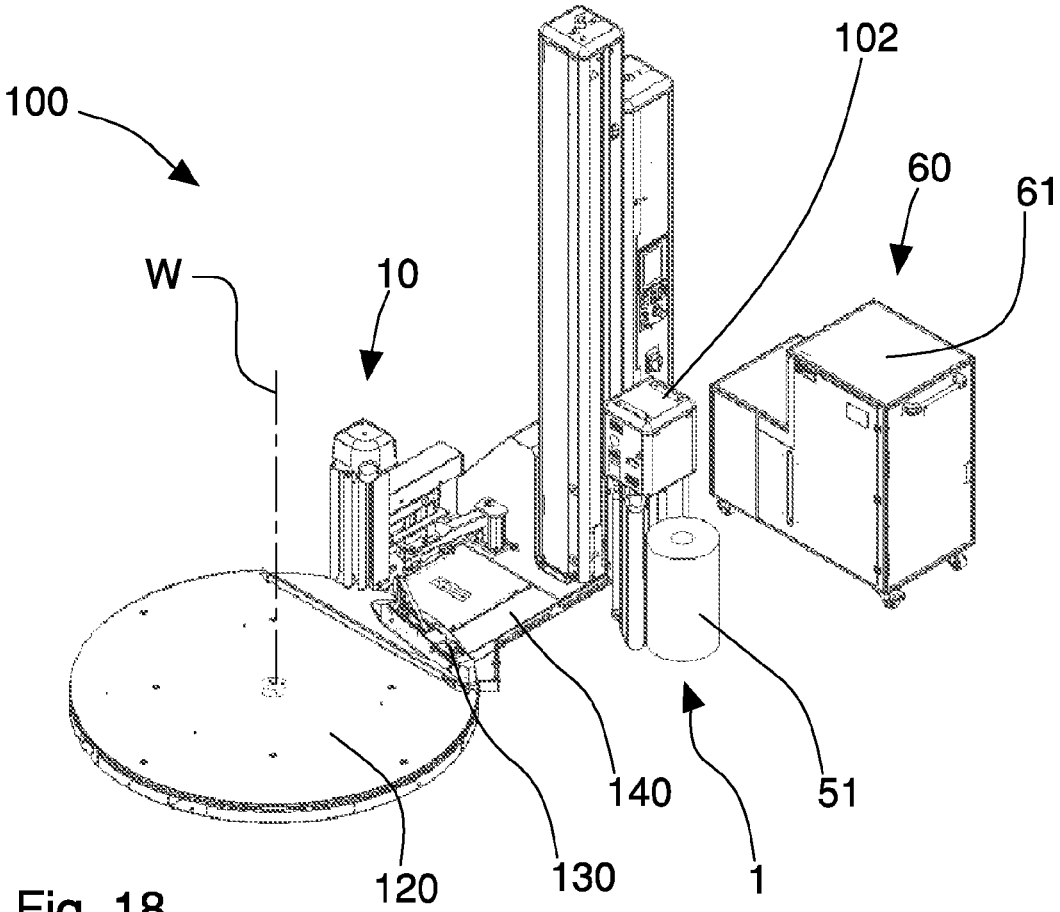
Fig. 18

APPARATUS, MACHINE AND METHOD FOR WRAPPING A LOAD

The invention relates to apparatuses, machines and methods for wrapping a load with a paper band.

The use of paper sheets and bands for packaging products, typically envelopes and bags, is known in the packaging sector. In particular, the use of Kraft-type paper, also called wrapping paper, for packaging is widely used, since this paper is characterized by a high resistance, in particular to traction and punctures and tears, and longitudinal and transverse elasticity. Kraft paper can be smooth or have creases or micro-creases that accentuate the elasticity thereof.

By virtue of its mechanical features and its complete recyclability, Kraft paper can also be validly used for wrapping palletized loads, i.e., loads formed by a single product or by a plurality of products grouped and arranged on a pallet, in place of the films of cold-extensible plastic material generally used. In fact, the need to reduce the use and consumption of plastics is increasingly felt also in the field of wrapping palletized products, which, as is known, if not correctly handled and above all disposed of, significantly contribute to environmental pollution. Paper is instead an eco-friendly and eco-sustainable material obtainable both from recycling pre-existing paper and from sustainable productions.

The known wrapping machines for wrapping with paper typically comprise an unwinding apparatus which is movable parallel and/or about a wrapping axis and which supports a reel of paper band from which the paper band is unwound to be wrapped around the load so as to form a series of strips or bands, generally having a helical trend, by virtue of the combination of the relative linear and rotational movements between the unwinding apparatus and the load.

In wrapping machines provided with a rotating table that supports the load, during the wrapping cycle the load is rotated about a vertical wrapping axis, while the unwinding apparatus is moved parallel to the wrapping axis with alternating motion along a fixed column of the wrapping machine.

In wrapping machines with horizontal rotating ring or rotating arm, the load remains static during the wrapping, while the unwinding apparatus is moved with respect to the latter both in rotation about a vertical wrapping axis and in translation parallel to the latter. To this end, the unwinding apparatus is fixed to a ring structure or to an arm rotatably supported by a machine frame and so as to rotate around the load.

In wrapping machines with a vertical rotating ring the load is moved horizontally through the ring structure, while the unwinding apparatus fixed to the ring structure is rotated about a horizontal axis.

The unwinding apparatus is generally provided with a series of rollers for diverting the unwound paper band from the reel towards the load during the unwinding.

In order to avoid folding and creasing in the paper during the wrapping, the unwinding apparatus is generally mounted on the wrapping machine so that it can be inclined about a horizontal axis by an angle substantially equal to the helical wrapping angle, such a helical angle being a function, as known, of the vertical linear displacement of the unwinding apparatus in a wrapping revolution.

To this end, different solutions are known for tilting the unwinding apparatus, which are generally quite complex and expensive, as they comprise motors or mechanical systems with elastic means.

At the end of the wrapping the paper band must be fixed to the load and then cut to obtain a first paper flap or end fixed to the load and a second paper end connected to the reel and retained by special gripping means. In particular, the first paper end is positioned by suitable pressing means on the load and fixed to the layers of paper already wrapped around the load by means of glue or adhesive.

Cutting means are also included for cutting the paper band.

A problem of the pressing and cutting means of the known wrapping machines lies in the difficulty of executing a precise and correct cut of the paper and in making the first end of paper, which is obtained from the cut, optimally adhere to the load.

EP 3835220 discloses a machine for wrapping one or more products with a band of material comprising a support on which a main reel is rotatably positioned, from which the material band is unwound, a vertical guide and a wrapping head movable along the vertical guide.

The wrapping head comprises at least one wrapping/unwinding roller rotatable in one direction to allow the wrapping therearound of a predetermined length of the material band and rotatable in the opposite direction to be able to unwind at least in part the band wrapped therearound so that a prefixed length of band can be unwound from the main reel to be wrapped around the wrapping/unwinding roller to execute a wrapping by subsequently unwinding at least one part of the aforesaid band.

An object of the invention is to improve the known wrapping machines and wrapping methods for wrapping a load with a paper band, as well as the wrapping apparatuses associable with wrapping machines for dispensing a paper band with which to wrap a load. Another object is to provide a wrapping machine, an unwinding apparatus associable with a wrapping machine and a wrapping method which allow any type of load to be wrapped firmly and compactly by means of a paper band, avoiding the formation of folds and creases on said band during the wrapping and reducing and substantially eliminating the risks of its breakage or tearing.

A further object is to provide a wrapping machine, a wrapping apparatus associable with a wrapping machine and a wrapping method which allow to optimally fix the various tapes or strips of paper band wrapped around the load and in particular an end of such a paper band so as to achieve a firm, compact and robust wrapping of the load, in particular of a palletized load formed by a plurality of products grouped and overlapped on a pallet.

A still further object is to provide a wrapping machine, a wrapping apparatus associable with a wrapping machine and a wrapping method which allow to precisely and accurately cut the paper band at the end of the wrapping and to optimally fix an end of the paper band obtained from cutting to a side wall of the load.

Another further object is to provide a wrapping machine and an unwinding apparatus having simple and economical construction and precise and reliable operation.

In a first aspect of the invention a wrapping machine according to claim 1 is provided.

In a second aspect of the invention, an unwinding apparatus associable with a wrapping machine according to claim 12 is provided.

In a third aspect of the invention a method for wrapping a load according to claim 16 is provided.

The invention can be better understood and implemented with reference to the attached drawings which illustrate exemplifying and non-limiting embodiments thereof, in which:

FIG. 1 is a perspective view of the wrapping machine of the invention in particular provided with an unwinding apparatus of a paper band of the invention;

FIG. 2 is an enlarged perspective side view of the wrapping machine of FIG. 1 illustrating in particular the unwinding apparatus;

FIG. 3 is a partial side view of the wrapping machine of FIG. 1;

FIG. 4 is an enlarged perspective view of the unwinding apparatus of the invention;

FIG. 5 is a perspective view from a different angle of the unwinding apparatus of FIG. 4;

FIG. 6 is a plan view from above of the unwinding apparatus of FIG. 5;

FIGS. 7 and 8 are respectively front and rear perspective views of linking elements of the unwinding apparatus of FIG. 1;

FIG. 9 is a rear view of the linking elements of FIGS. 7 and 8;

FIG. 10 is a section according to the plane X-X of FIG. 9;

FIGS. 11 and 12 are schematic front views illustrating respective steps of a wrapping cycle of a load executed by the wrapping machine of FIG. 1;

FIG. 13 is a partial perspective view of the wrapping machine of the invention illustrating in particular a system for pressing and cutting the paper band in an operative configuration;

FIG. 14 is another partial perspective view from a different angle of the pressing and cutting system of FIG. 13 in the operative configuration and without upper covering means;

FIG. 15 is an enlarged partial perspective view of the pressing and cutting system of FIG. 13 illustrating upper covering means associated with the cutting means;

FIG. 16 is a partial plan view from above of the pressing and cutting system of FIG. 13 associated with a paper band and lacking upper covering means;

FIG. 17 is a partial perspective view of the pressing and cutting system of FIG. 13 lacking upper covering means illustrating in particular the cutting means;

FIG. 18 is a perspective view of the wrapping machine of the invention associated with a feeding unit of adhesive substance.

Referring to FIGS. 1 to 17, the wrapping machine 100 of the invention is arranged to wrap a load 200 with a paper band 50 unwound from a reel 51. The paper band 50 is for example a band of a known and commercially available Kraft-type paper.

The wrapping machine 100 comprises a table 120 adapted to support the load 200, for example formed by a single product or by a plurality of products grouped and arranged on a pallet, and rotatable about a wrapping axis W, in particular substantially vertical. The wrapping machine 100 also comprises an unwinding apparatus 1 and moving means 101 for supporting and moving the unwinding apparatus 1 parallel to the wrapping axis W.

In particular, the unwinding apparatus 1 comprises a supporting frame 2 arranged to rotatably support the paper reel 51 and roller means 20 for unwinding from the reel 51 and guiding the paper band 50, in particular towards the load 200 during the wrapping thereof. The moving means 101 comprise a moving carriage 102 movable parallel to the wrapping axis W, in particular along a support column 103 of the wrapping machine 100, and supporting the wrapping apparatus 1 rotatably about an inclination axis S, in particular substantially orthogonal to the wrapping axis W.

With particular reference to FIGS. 3 to 10, the unwinding apparatus 1 comprises a first linking element 3 fixed to the supporting frame 2 and a second linking element 4 fixed to the moving carriage 102. The first and the second linking element 3, 4 are rotatably connected to each other about the inclination axis S at respective upper portions 3*a*, 4*a* by means of a linking pin 5. More precisely, the linking pin 5 is mounted on respective rolling bearings 28 mounted on respective seats made on the upper portions 3*a*, 4*a* of the first and the second linking element 3, 4.

A ball supporting element 6 is interposed between lower portions 3*b*, 4*b* of the linking elements 3, 4 for slidably supporting, in cooperation with the linking pin 5, the weight of the unwinding apparatus 1 and facilitating the rotation thereof about the inclination axis S during a wrapping cycle of the load 200.

More precisely, the ball supporting element 6 is rotatably housed in a seat 7 fixed, for example, in a respective lower portion 4*b* of the second linking element 4 to abut a rear wall 3*c* of the first linking element 3.

Alternatively, the ball supporting element 6 can be rotatably housed in a seat 7 fixed in a respective lower portion 3*b* of the first linking element 3 to abut a rear wall 4*c* of the second linking element 4.

The unwinding apparatus 1 further comprises an abutment pin 8, in particular substantially parallel to the inclination axis S, fixed to a respective rear wall 3*c*, 4*c* of the first linking element 3 or of the second linking element 4 and configured to engage in a slot 9 made in a respective rear wall 4*c*, 3*c* of the second linking element 4 or of the first linking element 3 to limit an inclination of the unwinding apparatus 1 about the inclination axis S.

In the embodiment shown in the figures, the abutment pin 8 is fixed to the rear wall 3*c* of the first linking element 3 and the slot 9, in particular through, is made in the rear wall 4*c* of the second linking element 4.

The slot 8 has an arcuate shape, and in particular it extends along an arc of circumference having a centre substantially coincident with the inclination axis S.

The slot 8 has longitudinal dimensions or lengths such as to allow the unwinding apparatus 1 to be rotatable about the inclination axis S, with respect to a reference plane H passing through the inclination axis S and the abutment pin 8 and with respect to the wrapping axis W, in both directions of rotation (counter-clockwise and clockwise with reference to FIGS. 11 and 12) at the most respectively by a first angle of maximum inclination $\alpha 1$ and by a second angle of maximum inclination $\alpha 2$. The first angle of maximum inclination $\alpha 1$ corresponds to the angle of maximum inclination of the unwinding apparatus 1 during an upwards movement thereof, in one step of the wrapping cycle of the load 100, while the second angle of maximum inclination $\alpha 2$ corresponds to the angle of maximum inclination of the unwinding apparatus 1 during a downwards movement thereof in another step of the wrapping cycle of the load 100.

As better explained in the following description, the unwinding apparatus 1 is inclined by the same paper band 50 during the wrapping of the load 200 so that the paper band is also inclined (more precisely its longitudinal edges 50*c* are inclined) with respect to the wrapping axis W by an angle (at the most equal to the first angle of maximum inclination $\alpha 1$ or the second angle of maximum inclination $\alpha 2$) substantially equal to a wrapping angle $\beta$ of the paper band 50 around the load 200, so as to avoid the formation of folds and/or creases on the paper band 50 itself.

As known, the wrapping angle β, or helical wrapping angle, is the angle formed by a longitudinal edge 50*c* of the paper band 50 with a reference plane M orthogonal to the wrapping axis W, i.e., substantially horizontal, said wrapping angle β being a function of a vertical linear displacement of the unwinding apparatus 1 in a wrapping revolution.

The angles of maximum inclination α1, α2 are comprised between 2° and 10° (sexagesimal degrees). The first angle of maximum inclination α1 and the second angle of maximum inclination α2 can be the same or different, for example the second angle of maximum inclination α2 can be less than the first angle of maximum inclination α1.

Each linking element 3, 4 comprises a respective elongated metal profile having a "U"-shaped transverse section and formed by a respective bottom wall 13, 43 and two side walls 14, 44. The two bottom walls 13, 43 of the linking elements 3, 4 are facing and the linking pin 5, the abutment pin 8 are fixed thereon, the slot 9 is made and the ball supporting element 6 is fixed.

The roller means 20 of the unwinding apparatus 1 comprise a plurality of guiding rollers 21 and an unwinding roller 22 controllable in rotation speed. In particular, the unwinding roller 2) is associated with a brake or a motor, so as to control a traction or "pulling" force of the paper band 50 during the wrapping cycle, in particular so as to keep the value of said traction force within a predefined range in order to avoid, on the one hand, the breakage of the paper band, on the other hand, a loose wrapping of the load.

With particular reference to FIGS. 2 and 26, the unwinding apparatus 1 further comprises at least one dispensing unit 15 of an adhesive substance adjustably fixed to a supporting rod 26 adjacent to a guiding roller 21 of the roller means 20 on which the paper band 50 exiting the unwinding apparatus 1 is wrapped.

In the illustrated embodiment, the unwinding apparatus 1 is provided with a pair of dispensing units 15, each of which is arranged to dispense dots or lines of fixed length of adhesive substance on portions of the paper band 50 intended to be wrapped on edges 200*a* of the load 200. The adhesive substance is, for example, a cold glue, provided to the dispensing units 15, for example, by an external feeding unit 60 which is separate and independent from the wrapping machine, as illustrated in FIG. 18.

The feeding unit 60 for feeding the dispensing units 15 with glue comprises a movable carriage 61 on wheels which houses a glue tank, a pump for withdrawing from the tank and sending the glue under pressure to the dispensing units 15 and a local control unit, for example a respective industrial computer or PLC, connected to the control unit of the wrapping machine 100 to control the operation of the pump, in particular to feed the dispensing units 15 with glue when required.

Alternatively, the feeding unit 60 can be mounted directly on the wrapping machine 100, for example associated with the unwinding unit 1.

With particular reference to FIGS. 13 to 17, the wrapping machine 100 of the invention also comprises a pressing and cutting system 10 of the paper band 50 which comprises pressing means 11 and cutting means 12 configured respectively to press a portion of the paper band 50 on the load 200, more precisely on a side wall thereof, at the end of the wrapping cycle and then cut said paper band 50 so as to make a first paper end which is fixed to the load 200 (to its side wall) and a second paper end which is connected to the reel 50, in particular it is held by suitable gripping means 130 of the wrapping machine 100, of known type and not described in detail, placed adjacent to the rotating table 120.

The pressing means 11 comprise at least one pair of pressing rollers 31 mounted idle, i.e., free to rotate about respective longitudinal axes, on a mounting frame 38 of the pressing and cutting system 10, adjacent to each other and parallel to the wrapping axis W.

The cutting means 12 comprise at least one blade 32 mounted on a driving carriage 33 which is movable linearly, in particular parallel to the wrapping axis W, so that in operation the blade 32 can abut and cut the paper band 50 along a cutting direction T transversal, in particular substantially orthogonal, to the external longitudinal edges 50*c* of the paper band. The cutting means 12 also comprise a guiding element 34 provided with a substantially flat abutment wall 34*a* parallel to the wrapping axis W and configured to engage and guide the paper band 50 coming from the unwinding apparatus 1 and moving towards the pressing means 11. The blade 32 is adjacent to the guiding element 34 and arranged and movable along a cutting plane T1 which is substantially parallel to the wrapping axis W, i.e., substantially vertical, and inclined with respect to the abutment wall 34*a* of the guiding element 34 by a cutting angle γ comprised between 70° and 90° (FIG. 16).

As better explained in the following description, by virtue of the guiding element 34 and the particular arrangement of the blade 32, the paper band 50, suitably stretched between the cutting means 12 and the unwinding apparatus 1, can be cut quickly, cleanly and precisely.

The blade 32 is reversibly fixed to the driving carriage 33 so as to be easily and quickly replaceable when worn and/or damaged.

The cutting means 12 comprise driving means 35 arranged to linearly move the driving carriage 33 along the cutting direction T. In the illustrated embodiment, the driving means 35 comprise a rotary electric motor 36 adapted to drive screw-nut means 39, of a known type and not described in detail, in rotation by motion transmission means 37, associated with and operating on the driving carriage 33.

The pressing and cutting system 10 comprises a first supporting arm 16 rotatably mounted about a first rotation axis X1, in particular on a base 140 of the wrapping machine 100, so as to rotate the entire pressing and cutting system 10 in an operative position A in which the pressing means 11 and the cutting means 12 are closer to the load 200. The first supporting arm 16 is also arranged to rotate the pressing and cutting system 10 in an inoperative position, not illustrated in the figures, in which the pressing means 11 and the cutting means 12 are spaced from the load 100 so as not to interfere with its wrapping.

The pressing and cutting system 10 also comprises a second supporting arm 17 slidably supported by the first arm 16 and supporting at a free end 17*a* thereof the pressing means 11 and the cutting means 12. In particular, the second supporting arm 17 is linearly movable to allow the pressing means 11 to abut the load 200, when the first supporting arm 16 is rotated in the operative position A.

The pressing and cutting system 10 further comprises covering means 40 arranged to contain and enclose the driving means 35 and provided with a housing 41 capable of housing and enclosing the blade 32 arranged in an inoperative position B. thereby the blade 32 is inaccessible to an operator for the safety and security of the latter.

Known-type sensor means not illustrated in the figures are associated with the cutting means 12 and are configured to detect at least the inoperative position B of the blade 32, and preferably a start and end stroke position of the driving carriage 33.

The operation of the wrapping machine 100 of the invention includes during a wrapping cycle of the load 200 that the unwinding apparatus 1 delivers the paper band 50 unwound from the reel 50 by virtue of the rotation about the wrapping axis W of the rotating table 120, on which the load 200 is positioned.

An initial end of the paper band 50 is previously fixed to the load 200 by virtue of the gripping means 130 which arranged in a raised position retain an initial end of paper band (for example obtained by cutting the paper band in a previous wrapping cycle) so that it is covered and pressed by one or more bands of paper band wrapped around the load, according to a well-known mode used in rotating table wrapping machines.

During the wrapping, the unwinding apparatus 1 is moved by the moving means 101 with reciprocating motion parallel to the rotation axis W so that the load 200 is wrapped by a plurality of partially overlapping paper strips or bands having a helical trend, by virtue of the combination of the relative, linear and rotation movements, between the unwinding apparatus and the load. In particular, the paper band 50 is wrapped with a predefined wrapping angle as a B (function of the vertical linear displacement of the unwinding apparatus 1 in a wrapping revolution).

Since the unwinding apparatus 1 is mounted on the moving carriage 102 of the moving means 101 in a rotatable manner about the inclination axis S, during the wrapping it can be inclined by the same paper band being wrapped so that the latter is inclined (more precisely its longitudinal edges 50*c* are inclined) with respect to the wrapping axis W by an inclination angle $\alpha$ which is substantially equal to the wrapping angle $\beta$ so as to avoid the formation of folds and/or creases on the paper band 50 itself.

In particular, by virtue of the first linking element 3 and the second linking element 4 (fixed respectively to the supporting frame 2 of the unwinding apparatus 1 and to the moving carriage 102) connected to each other in a rotatable manner about the inclination axis S by the linking pin 5 and by interposing the ball supporting element 6, the unwinding apparatus 1 can be inclined in a smooth and stable manner during the wrapping. It should be noted that the ball supporting element 6, interposed between the lower portions 3*b*, 4*b* of the linking elements 3, 4, in addition to allowing to slidably support, in cooperation with the linking pin 5, the weight of the unwinding apparatus 1, allows the latter to rotate precisely and accurately, avoiding in particular linear movements parallel to the inclination axis S which could compromise the correct dispensing of the paper band.

During the wrapping, the dispensing units 15, fed by the feeding unit 60, intermittently dispense adhesive substance onto the paper band 50 exiting from the unwinding apparatus 1. More precisely, dispensing units 15 are activated and controlled so as to deliver dots or lines of fixed length of an adhesive substance on the portions of the paper band 50 intended to be wrapped on the edges 200*a* (i.e., the vertical lines defined by the junction of two respective side walls) of the load 200.

Numerous tests carried out by the applicant have shown that when the overlapping strips or tapes of paper band 50 adhere and are joined together mainly at the edges 200*a* of the load 200, the resulting wrapping is more stable, robust and firm.

Upon completion of the wrapping of the load 200 with a defined number of strips or tapes of paper band 50, the rotating table 120 is stopped and the unwinding apparatus 1 is arranged in a lowered position. The pressing and cutting system 10 is activated so as to press with the pressing rollers 31 of the pressing means 11 the portion of paper band coming from the wrapping apparatus 1 against a side wall of the load 100.

More precisely, the first supporting arm 16 of the pressing and cutting system 10 is rotated about the first rotation axis X1 in the operative position A and the second supporting arm 17 is linearly moved towards the load 200 to push the paper band by means of the pressing rollers 31 against the side wall of the load 200. The portion of paper band which is pushed against the load 200 was previously sprinkled by the adhesive substance dispensing units (exiting from the unwinding apparatus). The pressing means 11 maintain the pressure for a defined time interval (for example from 4 to 10 s) to allow the adhesive substance to grip and firmly join the aforesaid portion of paper band with the underlying paper strips.

At the same time, the cutting means 12 are activated to cut the paper band and make a first paper end which is fixed to the load 200 (to its side wall) and a second paper end which is connected to the reel 50, in particular it is retained by the gripping means 130 of the wrapping machine 100 activated in a raised position so as to grip and retain the paper band.

More precisely, the blade 32 of the cutting means 12 mounted on the driving carriage 33 is moved from the inoperative position B along the cutting direction T, substantially orthogonal to the outer longitudinal edges 50*c* of the paper band, in particular with a downwards movement, so as to intercept and cut the paper band 50. The paper band abuts and engages the abutment wall 34*a*, which is substantially flat and parallel to the wrapping axis W, of the guiding element 34, with respect to which the blade 32 is inclined by a cutting angle $\gamma$ comprised between 70° and 90°. Therefore, by virtue of the guiding element 34 and the particular arrangement of the blade 32, the paper band 50, suitably stretched between the cutting means 12 and the unwinding apparatus 1, can be cut quickly, cleanly and precisely.

It should be noted that in the inoperative position B the blade 32 is housed inside the housing 41 of the covering means 40 so as not to be accessible to an operator.

The invention further concerns an unwinding apparatus 1 associable with a wrapping machine 100 for dispensing a paper band 50 with which to wrap a load 200.

The unwinding apparatus 1, illustrated in particular in FIGS. 2 to 10 and already described above, comprises a supporting frame 2 arranged to rotatably support a reel 51 of the paper band 50 and roller means 20 for unwinding the reel 51 and guiding the paper band 50. The unwinding apparatus 1 comprises in particular a first linking element 3 fixed to the supporting frame 2 and a second linking element 4 which can be fixed to moving means 101 of the wrapping machine 100 so as to be movable at least parallel to a wrapping axis W, in particular substantially vertical.

The first and the second linking element 3, 4 are connected to each other in a rotatable manner about an inclination axis S, in particular substantially orthogonal to the wrapping axis W, at respective upper portions 3*a*, 4*a* by means of a linking pin 5. A ball supporting element 6 is interposed between the lower portions 3*b*, 4*b* of the linking elements 3, 4 for slidably supporting in cooperation with the linking pin 5 the weight of said unwinding apparatus 1 and facilitating the rotation thereof about the inclination axis S during operation. In particular, the ball supporting element 6 is rotatably housed in a seat 7 e.g., fixed to a respective lower portion 4*b* of the second linking element 4 and is configured to abut a rear wall 3*c* of the first linking element 3.

The unwinding apparatus 1 further comprises an abutment pin 8 fixed to a respective rear wall 3*c*, 4*c* of the first linking element 3 or of the second linking element 4 and configured to engage in a slot 9, in particular through, made in a respective rear wall 4*c*, 3*c* of the second linking element 4 or of the first linking element 3 to limit an inclination of the unwinding apparatus 1 about the inclination axis S. The abutment pin 8 is substantially parallel to the inclination axis S.

Thereby, the unwinding apparatus 1 is rotatable about the inclination axis S, with respect to a reference plane H passing through the inclination axis S and the abutment pin 8 in the two rotation directions at the most respectively by a first angle of maximum inclination 1 and by a second angle of maximum inclination $\alpha$2.

The aforesaid angles of maximum inclination $\alpha$1, $\alpha$2 are comprised between 2 and 10.

Each linking element 3, 4 comprises a respective elongated metal profile having a "U"-shaped transverse section and formed by a respective bottom wall 13, 43 and two side walls 14, 44. The two bottom walls 13, 43 of the linking elements 3, 4 are facing and the linking pin 5, the abutment pin 8 are fixed thereon, the slot 9 is made and the ball supporting element 6 is fixed.

The unwinding apparatus 1 of the invention can be mounted on a wrapping machine of the rotating table type, in particular fixed to a moving carriage of the moving means 101 of the wrapping machine, movable parallel to the wrapping axis W, in particular along a support column.

Alternatively, the unwinding apparatus 1 can be mounted on a wrapping machine with horizontal rotating ring or rotating arm in which the load remains static during the wrapping, while the unwinding apparatus is moved with respect to the latter both in rotation about a vertical wrapping axis and in translation along the latter. In particular, the unwinding apparatus 1 can be fixed to a ring structure or to an arm rotatably supported by a machine frame and so as to rotate around the load.

The unwinding apparatus 1 of the invention can also be mounted on a vertical wrapping machine with rotating ring in which the load is moved horizontally through the ring structure, while the unwinding apparatus fixed to the latter is rotated about a horizontal axis.

Lastly, the unwinding apparatus 1 can be mounted on a self-propelled wrapping machine, or a self-propelled wrapping robot, in particular slidably connected to a vertical upright fixed to a self-propelled carriage or cart provided with motor-powered traction wheels and a guiding device comprising one or more steerable wheels, operated by a steering wheel.

The invention further relates to a method for wrapping a load 200 with a paper band 50 by means of the wrapping machine 1 described above and illustrated in FIGS. 1 to 17. Such a method comprises the following steps:

wrapping the paper band 50 unwound from the reel 51 around the load 200 by rotating one with respect to the other about a wrapping axis W, the load 200 and an unwinding apparatus 1 supporting the reel 51 of the wrapping machine 100;

adjusting during said wrapping an inclination of the paper band 50 with respect to the wrapping axis W by tilting the unwinding apparatus 1 about an inclination axis S by an angle substantially equal to a wrapping angle $\beta$ of the paper band 50 about the load 200 so as to avoid bending and/or creasing on the paper band 50;

delivering dots or lines of fixed length of an adhesive substance on portions of the paper band 50 intended to be wrapped on edges 200*a* of the load 200.

In particular, the adjusting by tilting said unwinding apparatus 1 is achieved by the paper band 50 being wrapped around the load 200, the unwinding apparatus 1 being free to rotate about the inclination axis S.

The method further comprises adjusting a traction or "pulling" force exerted by the paper band 50 on the load 200 during the wrapping of the latter with the paper band 50, in particular by adjusting a rotation speed of an unwinding roller 22 of roller means 20 of the unwinding apparatus 1, so as to avoid breakage of the paper band 50 (in case of excessive traction or tension force) or a loose wrapping of the load (in case of insufficient traction or tension force).

The invention claimed is:

1. A wrapping machine for wrapping a load with a paper band unwound from a reel, the wrapping machine comprising:

a table adapted to support the load, said table being and rotatable about a wrapping axis;

an unwinding apparatus comprising a supporting frame arranged to rotatably support the reel of paper band and rollers for unwinding from the reel and guiding the paper band;

a moving assembly comprising a moving carriage movable parallel to the wrapping axis and supporting said unwinding apparatus rotatably about an inclination axis;

wherein said unwinding apparatus further comprises a first linking element fixed to said supporting frame and a second linking element fixed to said moving carriage, said first and second linking elements being connected to each other in a rotatable way about the inclination axis at respective upper portions through a linking pin, and wherein said unwinding apparatus further comprises a ball supporting element interposed between lower portions of said first and second linking elements and able to slidably support, in cooperation with said linking pin, a weight of said unwinding apparatus and facilitating a rotation thereof about the inclination axis during a wrapping cycle of the wrapping machine.

2. The wrapping machine according to claim 1, wherein said ball supporting element is rotatably housed in a seat fixed to a respective lower portion of said second linking element or of said first linking element and is configured to slidably abut a rear wall of said first linking element or of said second linking element.

3. The wrapping machine according to claim 1, wherein said unwinding apparatus further comprises an abutment pin fixed to a respective rear wall of said first linking element or of said second linking element, said abutment pin being substantially parallel to the inclination axis and configured to engage a slot made in a respective rear wall of said second linking element or of said first linking element in order to limit an inclination of said unwinding apparatus about the inclination axis.

4. The wrapping machine according to claim 3, wherein said unwinding apparatus is rotatable about the inclination axis, with respect to a reference plane passing through the inclination axis and said abutment pin, in two rotation directions at the most respectively by a first angle of maximum inclination and by a second angle of maximum inclination.

5. The wrapping machine according to claim 4, wherein said first and second angles of maximum inclination range between 2° and 10°.

6. The wrapping machine according to claim 1, wherein said rollers comprise a plurality of guiding rollers and an unwinding roller controllable in rotation speed, so as to control a traction force of the paper band during the wrapping cycle.

7. The wrapping machine according to claim 1, wherein said unwinding apparatus further comprises at least one dispensing unit of adhesive substance.

8. The wrapping machine according to claim 7, wherein said at least one dispensing unit is adjustably fixed to a supporting rod adjacent to a guiding roller of said rollers on which the paper band exiting said unwinding apparatus is wound, said dispensing unit being arranged to deliver dots or lines of fixed length of adhesive substance on portions of the paper band intended to be wrapped on edges of the load.

9. The wrapping machine according to claim 1, further comprising a pressing and cutting system comprising a pressing assembly and a cutting assembly respectively for pressing a portion of the paper band on the load at an end of the wrapping cycle and for cutting the paper band so as to make a first paper end fixed to the load and a second paper end connected to the reel.

10. The wrapping machine according to claim 9, wherein said pressing assembly comprises a pair of pressing rollers mounted idle on a mounting frame of said pressing and cutting system, adjacent to each other and parallel to the wrapping axis.

11. The wrapping machine according to claim 9, wherein said cutting assembly comprises at least one blade mounted on a driving carriage movable linearly, said blade being configured to abut and cut the paper band along a cutting direction transversal to external longitudinal edges of the paper band.

12. The wrapping machine according to claim 11, wherein said cutting assembly further comprises a guiding element provided with an abutment wall that is substantially flat and parallel to the wrapping axis and configured to engage and guide the paper band coming from the unwinding apparatus and moving towards said pressing assembly, said blade being positioned adjacent to said guiding element and arranged and movable along a cutting plane that is substantially parallel to the wrapping axis and inclined with respect to said abutment wall of said guiding element by a cutting angle included between 70° and 90°.

13. The wrapping machine according to claim 9, wherein said pressing and cutting system further comprises a first supporting arm rotatably mounted about a first rotation axis so as to rotate said pressing and cutting system in an operative position, in which said pressing assembly and said cutting assembly are closer to the load, and a second supporting arm slidably supported by said first supporting arm, having a free end that supports said pressing assembly and said cutting assembly and linearly movable to allow said pressing assembly abutting the load.

14. A method for wrapping a load with a paper band by means of the wrapping machine according to claim 1, the method comprising:

wrapping the paper band unwound from a reel around the load by rotating one with respect to the other about a wrapping axis the load and an unwinding apparatus of the wrapping machine supporting the reel;

adjusting during said wrapping an inclination of the paper band with respect to the wrapping axis by tilting said unwinding apparatus about an inclination axis by an inclination angle nearly equal to a wrapping angle of the paper band around the load so as to avoid creation of at least one between folds and creases on the paper band;

delivering dots or lines of fixed length of an adhesive substance on portions of the paper band intended to be wrapped on edges of the load.

15. The method according to claim 14, wherein said adjusting by tilting said unwinding apparatus is made from the paper band being wrapped around the load, said unwinding apparatus being free to rotate about the inclination axis.

16. The method according to claim 14, further comprising adjusting a traction force exerted by the paper band on the load during said wrapping thereof with the paper band, in order to avoid breaking of the paper band or a loose wrapping of the load.

17. The method according to claim 16, wherein the traction force exerted by the paper band on the load during said wrapping thereof with the paper band is adjusted by adjusting a rotation speed of an unwinding roller of rollers of said unwinding apparatus.

18. An unwinding apparatus associable with a wrapping machine in order to deliver a paper band with which to wrap a load, the unwinding apparatus comprising a supporting frame arranged to rotatably support a reel of the paper band and rollers for unwinding from the reel and guiding the paper band, wherein the said unwinding apparatus further comprises a first linking element fixed to said supporting frame and a second linking element which can be fixed to a moving assembly of the wrapping machine so as to be moved at least parallel to a wrapping axis, said first and said second linking elements being connected to each other in a rotatable way about an inclination axis at respective upper portions through a linking pin, and a ball supporting element being interposed between lower portions of said first and second linking elements in order to slidably support, in cooperation with said linking pin, a weight of the unwinding apparatus and facilitate a rotation thereof about the inclination axis during a wrapping cycle of the wrapping machine.

19. The unwinding apparatus according to claim 18, wherein said ball supporting element is rotatably housed in a seat that is fixed to a respective lower portion of said second linking element or of said first linking element and is configured to slidably abut a rear wall of said first linking element or of said second linking element.

20. The unwinding apparatus according to claim 18, further comprising an abutment pin fixed to a respective rear wall of said first linking element or of said second linking element, said abutment pin being substantially parallel to the inclination axis and configured to engage a slot made in a respective rear wall of said second linking element or of said first linking element in order to limit an inclination of the unwinding apparatus about the inclination axis.

21. The unwinding apparatus according to claim 20, wherein the unwinding apparatus is freely rotatable about the inclination axis with respect to a reference plane passing through the inclination axis and said abutment pin, in two rotation directions at the most respectively by a first angle of maximum inclination and by a second angle of maximum inclination.

22. The unwinding apparatus according to claim 21, wherein the first and second angles of maximum inclination are included between 2 and 10°.

* * * * *